US006732654B2

(12) United States Patent
Suda et al.

(10) Patent No.: US 6,732,654 B2
(45) Date of Patent: May 11, 2004

(54) METHOD FOR PRODUCING A PHOTOCATALYTIC PRINTING PLATE BY FILM TRANSFER

(75) Inventors: Yasuharu Suda, Mihara (JP); Toyofumi Shimada, Mihara (JP); Hitoshi Isono, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/413,302

(22) Filed: Apr. 15, 2003

(65) Prior Publication Data

US 2003/0205158 A1 Nov. 6, 2003

Related U.S. Application Data

(62) Division of application No. 09/866,657, filed on May 30, 2001, now Pat. No. 6,564,713.

(30) Foreign Application Priority Data

May 31, 2000 (JP) ..... P2000-163243

(51) Int. Cl.[7] ..... B41C 1/10

(52) U.S. Cl. ..... 101/465; 101/456; 101/466; 101/467; 101/478

(58) Field of Search ..... 101/453, 454, 101/456, 457, 462, 463.1, 465, 466, 467, 478; 430/302

(56) References Cited

U.S. PATENT DOCUMENTS

| | | | | | |
|---|---|---|---|---|---|
| 4,718,340 | A | | 1/1988 | Love, III | 101/467 |
| 4,846,065 | A | * | 7/1989 | Mayrhofer et al. | 101/453 |
| 4,958,564 | A | * | 9/1990 | Fuhrmann et al. | 101/467 |
| 5,213,041 | A | | 5/1993 | Kanck | 101/487 |
| 5,382,964 | A | * | 1/1995 | Schneider | 347/213 |
| 5,511,477 | A | | 4/1996 | Adler et al. | 101/401.1 |
| 5,601,022 | A | * | 2/1997 | Dauer et al. | 101/467 |
| 6,196,129 | B1 | | 3/2001 | Kellett | 101/467 |

FOREIGN PATENT DOCUMENTS

| | | |
|---|---|---|
| EP | 0911155 | 4/1999 |
| JP | 63-102936 | 5/1988 |
| JP | 11-254633 | 9/1999 |
| JP | Hei 11-258860 | 9/1999 |
| JP | Hei 11-344804 | 12/1999 |
| JP | 2000-62334 | 2/2000 |
| JP | 2000-62335 | 2/2000 |
| JP | 2000-181068 | 6/2000 |

* cited by examiner

*Primary Examiner*—Stephen R. Funk
(74) *Attorney, Agent, or Firm*—Armstrong, Kratz, Quintos, Hanson & Brooks, LLP

(57) ABSTRACT

A method for making a printing plate including a step of forming a hydrophobic image area on at least a part of a hydrophilic surface of a plate. The plate surface contains a photocatalyst and the image area is formed by using an organic compound which is decomposed and removed by the irradiation of light having a higher energy than the band gap energy of the photocatalyst.

2 Claims, 5 Drawing Sheets

3
4
5
6
P

3
P
8
7
3
5
4
3

METHOD FOR PRODUCING A PHOTOCATALYTIC PRINTING PLATE BY FILM TRANSFER

This application is a divisional of prior application Ser. No. 09/866,657 filed May 30, 2001, now U.S. Pat. No. 6,564,713, which is hereby incorporated by reference.

BACKGROUND OF THE INVENTION

1. Field of the Invention

The present invention relates to a printing plate, a method for making a printing plate, a reusing method for the printing plate, and a printing machine. More specifically, the present invention relates to methods for making and reusing a printing plate on which an image is written based on digital data, and a printing machine using such a printing plate.

2. Description of Related Art

Recently, in general printing methods, many printing steps have become digital. That is, image data are digitized by producing an image or text using, for instance, a personal computer, or by scanning an image using a scanner, and a printing plate is formed based directly on the digitized data. In this manner, printing workflow may be improved and the entire printing process may be abbreviated, and execution of high image quality has been facilitated.

A so-called PS plate (i.e., a presensitized plate) has been generally utilized as a plate in a conventional printing process. The PS plate usually includes a hydrophilic non-image area, which is made of anodized aluminum oxide, and a hydrophobic image area which is formed on the surface of the hydrophilic non-image area by curing a photosensitive resin. However, a plurality of steps is required for making a printing plate using the PS plate, and hence, it is expensive and time-consuming to make such a plate. Accordingly, it is not easy to shorten the time required for the overall printing process and to lower the cost thereof. This is one of the main factors increasing the cost of printed matter, particularly for short run printing. Also, a developing step in which a developer is used is required for cases where the PS plate is employed, and hence, it is not only a time-consuming process, but also creates a problem, from the viewpoint of preventing environmental pollution, in that developer waste must be treated.

Also, a method, in which a film containing punched out information of an original image is made to contact with a printing plate and is subjected to light exposure, is conventionally used for making the PS plate, and this production of the printing plate is one of the obstacles which prevents the formation of a plate directly from digital data and the digitalization of the printing process. Moreover, in a conventional method, a printing plate must be replaced with a new one after print job, and the used plate has been discarded.

There are some commercial methods which, in consideration for the above-mentioned disadvantage of using the PS plate, correspond to the digitized printing process and in which the developing process may be omitted. For instance, Japanese Unexamined Patent Application, First Publication, No. 63-102936 discloses a preparation method in which ink containing a photosensitive resin is used for a liquid ink jet printer to be injected onto a printing plate material and an image area formed by the ink is cured by a photo irradiation process. Also, Japanese Unexamined Patent Application, First Publication No. 11-254633 discloses a method in which a color offset printing plate is made using an ink jet head which discharges a solid ink.

Moreover, a method is known in which a printing plate is made by sequentially applying a laser absorbing layer made of carbon black and a silicone resin layer onto a PET (polyethylene terephthalate) film, and heating the laser absorbing layer by drawing an image using a laser beam so that the silicone resin is subjected to laser ablation. Another method is also known in which a printing plate is made by sequentially applying a lipophilic laser absorbing layer and a hydrophilic layer onto an aluminum plate and subjecting the hydrophilic layer to laser ablation in the same manner as above using the laser beam.

Further, a method has been proposed in which a hydrophilic polymer is used as a recording media and a plate is made by converting an irradiated part to be lipophilic by an optical imaging.

However, by applying the above-mentioned methods, although it may be possible to make a plate directly from digital data, the plate must be replaced with a new one, after print job, in order to start the next printing process, and hence, the used plate is also wasted in these methods.

SUMMARY OF THE INVENTION

Accordingly, an object of the invention is to provide a reusable printing plate and a method for making a reusable printing plate which may be directly imaged based on digital data and has a high image quality without chemical processing. Another object of the invention is to provide a method for reusing such a printing plate so that the plate may be used repeatedly. Yet another object of the invention is to provide a printing machine capable of using such a printing plate.

The present invention provides a printing plate, including a hydrophilic surface of a plate containing a photocatalyst; and a hydrophobic image area containing an organic compound which is present on at least a part of the hydrophilic surface, the organic compound being decomposed and removed by the irradiation of light having a higher energy than a band gap energy of the photocatalyst.

In accordance with another aspect of the invention, the photocatalyst is a titanium dioxide photocatalyst.

In yet another aspect of the invention, the hydrophobic image area is formed by discharging an ink type liquid containing the organic compound onto the hydrophilic surface of the printing plate using an ink-jet imaging device.

In yet another aspect of the invention, the hydrophobic image is formed by transferring an ink type material containing the organic compound onto the hydrophilic surface of the printing plate by using a film on which the ink type material containing the organic compound has been applied and a transfer device.

In yet another aspect of the invention, the organic compound is an organotitanium compound.

In yet another aspect of the invention, the organic compound is an organosilicone compound.

In yet another aspect of the invention, the organic compound is a fatty acid dextrin.

The present invention also provides a method for making a printing plate, including a step of forming a hydrophobic image area on at least a part of a hydrophilic surface of a plate containing a photocatalyst by using an organic compound which is decomposed and removed by the irradiation of light having a higher energy than a band gap energy of the photocatalyst.

According to the above method, it is possible to convert the plate surface to be hydrophilic by irradiating the plate surface with light having a higher energy than the band gap energy of the photocatalyst. This is due to the action that the photocatalyst per se is converted to be hydrophilic. The surface converted into hydrophilic functions as a non-image area to which a hydrophobic ink does not attach. A hydrophobic image is formed on the hydrophilic plate surface by using an organic compound, which may be decomposed by the action of the photocatalyst under the irradiation of light having a higher energy than the band gap energy of the photocatalyst, and used as an image area to which the hydrophobic ink is attached in order to exert the function as a printing plate.

Also, after the printing process is completed and ink on the plate surface is removed, the organic compound is decomposed by the action of the photocatalyst by the irradiation of light having a higher energy than the band gap energy of the photocatalyst onto the surface so that the plate surface is converted to be hydrophilic. Accordingly, it becomes possible to recover the plate to a state prior to the formation of the image area thereof.

In accordance with another aspect of the invention, the photocatalyst used in the above method for making a printing plate is a titanium dioxide photocatalyst.

In yet another aspect of the invention, the hydrophobic image area is formed by discharging an ink type liquid containing the organic compound onto the hydrophilic surface of the plate using an ink-jet imaging device.

In yet another aspect of the invention, the hydrophobic image area is formed by transferring an ink type material containing the organic compound onto the hydrophilic surface of the plate by using a film (e.g., a thermal transfer ribbon) on which the ink type material containing the organic compound has been applied and a transfer device.

In yet another aspect of the invention, the organic compound used in the above method is an organotitanium compound.

In yet another aspect of the invention, the organic compound used in the above method is an organosilicone compound.

In yet another aspect of the invention, the organic compound used in the above method is a fatty acid dextrin.

The present invention also provides a reusing method for a printing plate made by using a method described above, including the steps of removing ink from the surface of the printing plate after the completion of a printing process; and reusing the printing plate by converting the surface of the printing plate so as to be hydrophilic by decomposing and removing a hydrophobic image area on the printing plate by the irradiation of light having a higher energy than the band gap energy of a photocatalyst onto the surface of the printing plate.

According to the above reusing method, since the plate surface is readily regenerated by irradiating light having a higher energy than the band gap energy of the photocatalyst, time and cost required for the regeneration process of the plate can be significantly and effectively reduced.

The present invention also provides a printing machine including a print drum which is provided with a hydrophilic plate surface containing a photocatalyst; a plate cleaner which removes ink on the plate surface; a light irradiation device which irradiates light having a higher energy than the band gap energy of the photocatalyst onto the plate surface; an image formation device which forms a hydrophobic image area on at least a part of the plate surface by using an organic compound which is decomposed and removed by the irradiation of light having a higher energy than the band gap energy of the photocatalyst; and a dryer which dries the plate surface.

According to the above printing machine, the production and regeneration process of the plate may be carried out by using the printing machine.

In accordance with another aspect of the invention, the light irradiation device, the image formation device, and the dryer are disposed in that order around the print drum with respect to the direction of rotation of the print drum.

According to the above printing machine, the production and regeneration process of the plate may be performed continuously in association with the rotation of the print drum.

In yet another aspect of the invention, the photocatalyst used in the above printing machine is a titanium dioxide photocatalyst.

In yet another aspect of the invention, the image forming device is provided with an ink jet head, which discharges and ink type liquid containing the organic compound and forms the hydrophobic image area on the hydrophilic plate surface.

In yet another aspect of the invention, the image forming device is provided with a film on which the ink type material containing the organic compound has been applied and a transfer device which transfers the ink type material containing the organic compound onto the hydrophilic plate surface from the film, and forms the hydrophobic image area on the hydrophilic plate surface.

In yet another aspect of the invention, the organic compound used by the image formation device is an organotitanium compound.

In yet another aspect of the invention, the organic compound used by the image formation device is an organosilicone compound.

In yet another aspect of the invention, the organic compound used by the image formation device is a fatty acid dextrin.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of particular preferred embodiments, set out below to enable one to build and use particular implementations of the invention, is not intended to limit the enumerated claims, but to serve as particular examples thereof.

Figure 1:
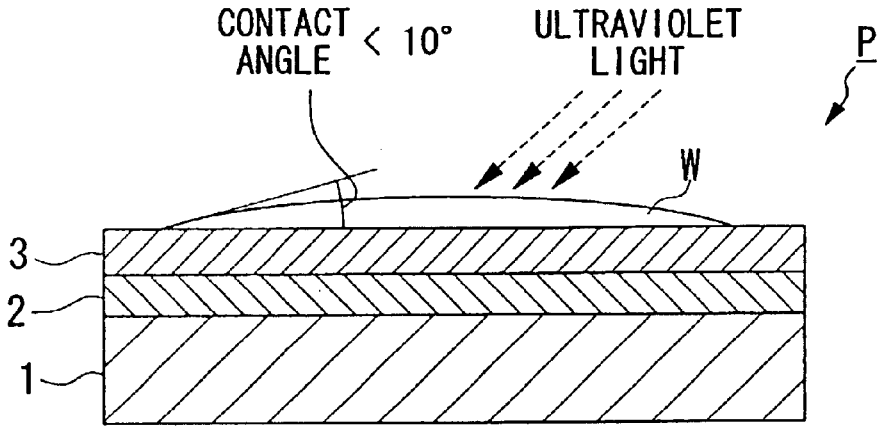
FIG. 1 is a cross-sectional view showing the structure of a printing plate used for a method for making a printing plate and a reusing method for the printing plate according to an embodiment of the present invention, as well as showing a hydrophilic property of a coating layer surface.

FIG. 1 is diagram showing a cross-sectional view of the surface of a printing plate according to an embodiment of the present invention. In FIG. 1, a printing plate P includes a base material 1, an intermediate layer 2, and a coating layer (printing surface) 3. In this embodiment, the base material 1 is made of a metal such as aluminum or stainless steel. Note that the material used for the base material 1 is not particularly limited to a metal and other materials may also be used.

The intermediate layer 2 is formed on the surface of the base material 1. Examples of a material which may be used to form the intermediate layer 2 include a silicone type compound such as, for instance, silica ($SiO_2$), a silicone resin, and a silicone rubber. Among these, in particular, as a silicone resin, alkyd silicone, urethane silicone, epoxy silicone, acrylic silicone, polyester silicone and so forth may be used. The function of the intermediate layer 2 includes an improvement in the contact between the base material 1 and the coating layer 3 (which will be described later) to assure the adhesion of the coating layer 3 to the base material 1. By placing the intermediate layer 2 between the base material 1 and the coating layer 3, if necessary, it becomes possible to maintain the bonding strength of the coating layer 3 to the base material 1. Note that the intermediate layer 2 may be unnecessary for the case where a sufficient bonding strength of the coating layer 3 to the base material 1 is obtained.

The coating layer 3 which includes titanium oxide as a photocatalyst in this embodiment is formed on the intermediate layer 2. The surface of the coating layer (printing surface) 3 exhibits a highly hydrophilic property when irradiated by a light having a higher energy than the band gap energy of the photocatalyst, such as ultraviolet rays. This phenomenon occurs due to the properties of the titanium oxide photo catalyst.

In order to maintain the above-mentioned properties or hydrophilicity, or to improve the strength of the coating layer 3 or adhesion to the base material 1, various additives may be added to the coating layer 3. Examples of such additives include silica compounds, such as silica, silica sol, organosilane, and a silicone resin, metallic oxides made of such metals as zirconium and aluminum, and fluorinated resins.

As a titanium oxide photocatalyst, a rutile type, an anatase type, and a brookite type are known and any of these titanium oxide photocatalysts may be used according to the embodiment of the present invention alone or in mixture. Also, as will be described later, it is preferable that the particle size of the titanium oxide photocatalyst be small to a certain degree. More specifically, it is preferable that the particle size of the titanium oxide photocatalyst be about 0.1 $\mu$m or less in order to increase its photocatalytic function by which organic compounds are decomposed via a photo irradiation process in which a light having a higher energy than the band gap energy of the photocatalyst is used. Note that although the use of titanium oxide photocatalyst is appropriate according to the present invention, it is not limited as such, and other photocatalysts may also be suitably used according to an embodiment of the present invention.

Examples of commercially available titanium oxide photocatalysts which may be used in embodiments of the present invention include: ST-01, ST-21, ST-K01 (a processed product of the former), ST-K03, STS-01 (a dispersion type), STS-02, and STS-21 (all of which are products of Ishihara Sangyo Kaisha, Ltd.); SSP-25, SSP-20, SSP-M, CSB, CSB-M, LACTI-01 (a coating type), and LACTI-03-A (products of Sakai Chemical Industry Co., Ltd.); TKS-201, TKS-202, TKC-301, and TKC-302 (products of Tayca Corporation); and PTA, TO, and TPX (products of Tanaka Tensha Ltd.).

Also, it is preferable that the thickness of the coating layer 3 be within the range between about 0.01 and 10 $\mu$m. This is because if the thickness of the coating layer 3 is too small, it becomes difficult to obtain the above-mentioned characteristics of the coating layer 3, and if the thickness of the coating layer 3 is too large, the layer 3 tends to be easily cracked and decreases the printing resistance property. Since the generation of cracks is often observed when the thickness of the coating layer 3 exceeds 20 $\mu$m, it is necessary to recognize this thickness of 20 $\mu$m as the upper limit even for the cases where the above-mentioned range between about 0.01 and 10 $\mu$m should be modified. Moreover, in practice, it is preferable that the thickness of the coating layer 3 be within the range between about 0.1 and 3 $\mu$m.

As a method for forming the coating layer 3, a sol application method, an organic titanate method, a vapor deposition method and so on may be suitably selected and employed. If an application method is used, various additives such as solvents, cross-linking agents, and surfactants may be added to an application liquid in addition to the titanium oxide photocatalyst and the above-mentioned various materials which improve the strength of the coating layer 3 and adhesion to the base material 1. Also, although the application liquid may be an ordinary-temperature dry-type or a heat-dry type, the use of the latter is preferable. The reason for this is that it is advantageous for increasing the strength of the coating layer 3 by heat in order to improve the printing resistance property of the resultant plate.

Next, a method for making the printing plate P will be explained.

As shown in FIG. 1, a light of a wavelength having a higher energy than the band gap energy of the titanium oxide photocatalyst is irradiated onto the surface of the coating layer 3 so that the entire coating layer 3, which is the surface of the printing plate P, turns into a hydrophilic surface having a contact angle of about 10° with respect to water W. This state is called "the initial state of plate-making". Note that "light of a wavelength having a higher energy than the band gap energy of the titanium oxide photocatalyst" means, more specifically, ultraviolet light having wavelengths of 400 nm or less.

Note that the term "plate-making" used hereinafter means the formation of an image area on a plate surface based on digital data by using an ink type material containing an organic compound which is readily decomposed by the action of a titanium oxide photocatalyst under the irradiation of ultraviolet light. Also, the term "organic compound" used hereinafter means an organic compound having a property of "being decomposed by the action of a photocatalyst under irradiation of light having a higher energy than the band gap energy of the photocatalyst".

As it can be seen from FIG. 1, in the initial state of plate-making, the surface of the coating layer 3 is wet by water W, i.e., the hydrophilicity of the coating layer 3 is initially very high. In other words, at the initial state of plate-making, it is difficult for the hydrophobic printing ink to be adhered to the surface of the coating layer 3.

Note that the above-mentioned phrase "the initial state of plate-making" may be regarded as referring to the start of the actual printing process. More specifically, it may be regarded as the state in which digitized data of a given image have been already prepared and the data are about to be written onto the plate.

Figure 2:
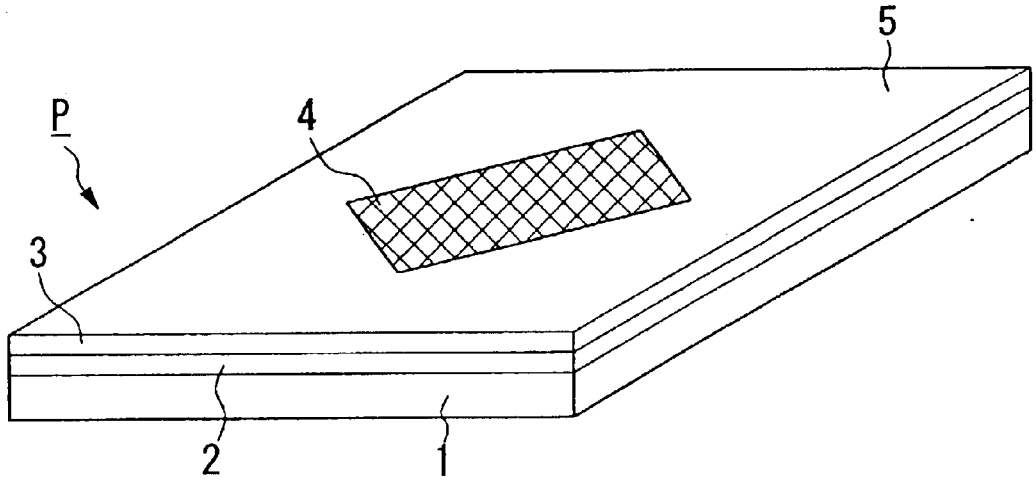
FIG. 2 is a diagram showing an example of an image (an image area) formed on a plate surface and background (a non-imaging portion)

Next, in an image formation process, an image area 4 is formed on the surface of the coating layer 3 in the above-mentioned state as shown in FIG. 2. The formation of the image area 4 is carried out accordingly to digital data relating to the image so as to correspond to the digital data. The image area 4 is a hydrophobic portion whose contact angle with respect to water is about 50° or more, preferably 80° or more, and hence, the printing hydrophobic ink is easily adhered to the image area 4, whereas water is difficult to adhere to the image area 4.

As a method for forming the hydrophobic image area 4 based on the image data, use of a so-called ink jet method in which an ink type liquid containing an organic compound is ejected onto the coating layer 3 is appropriate according to an embodiment of the present invention.

Figures 3A, 3B, 3C:
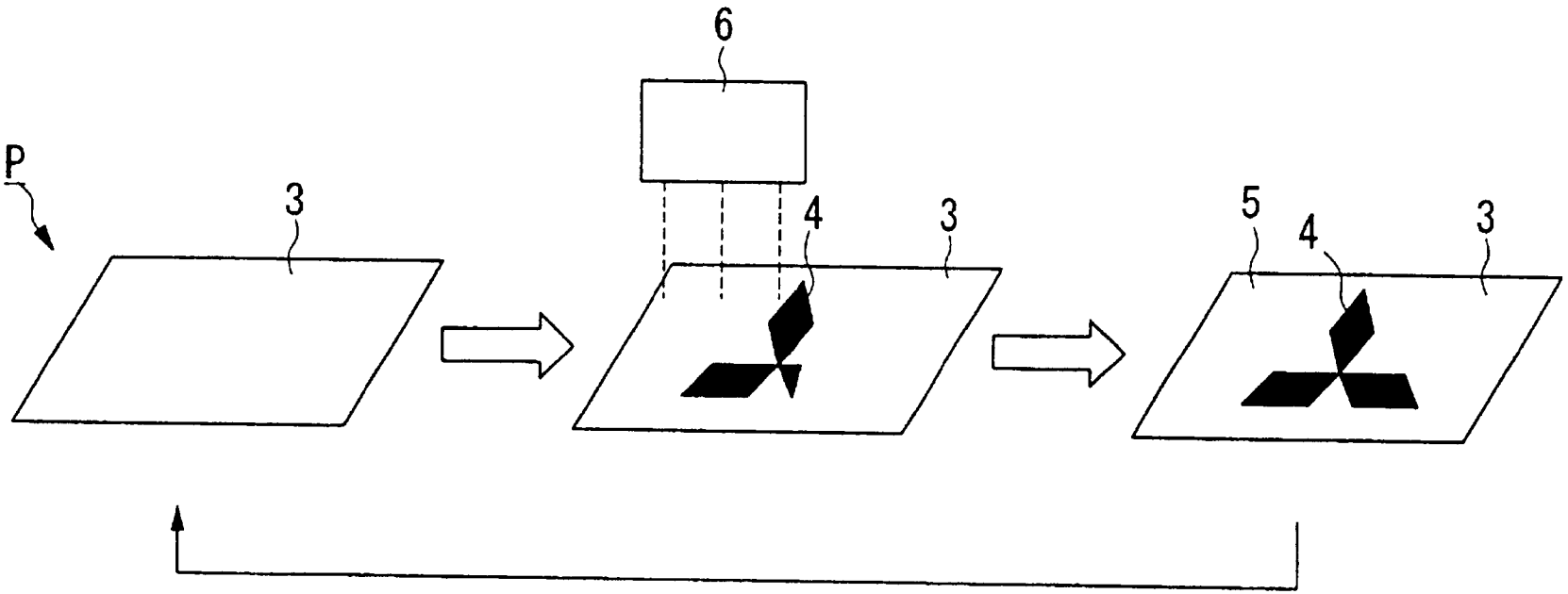
FIG. 3A shows a printing plate in the initial state of plate-making.
FIG. 3B shows a state in which an image area is formed on a coating layer by using an ink jet head.
FIG. 3C shows a state in which the formation of the image area is completed and is ready for printing.

FIGS. 3A through 3C are diagrams showing the formation of the image area 4 by using a ink jet head (i.e., a discharge device) 6 and the concept of plate-making after the completion of a printing process. In the figures, FIG. 3A shows a printing plate P in its initial state of plate-making. FIG. 3B shows a state in which the image area 4 is formed on the coating layer 3 by using the ink jet head 6. FIG. 3C shows a state in which the formation of the image area 4 is completed and is ready for printing.

Figures 4A, 4B, 4C:
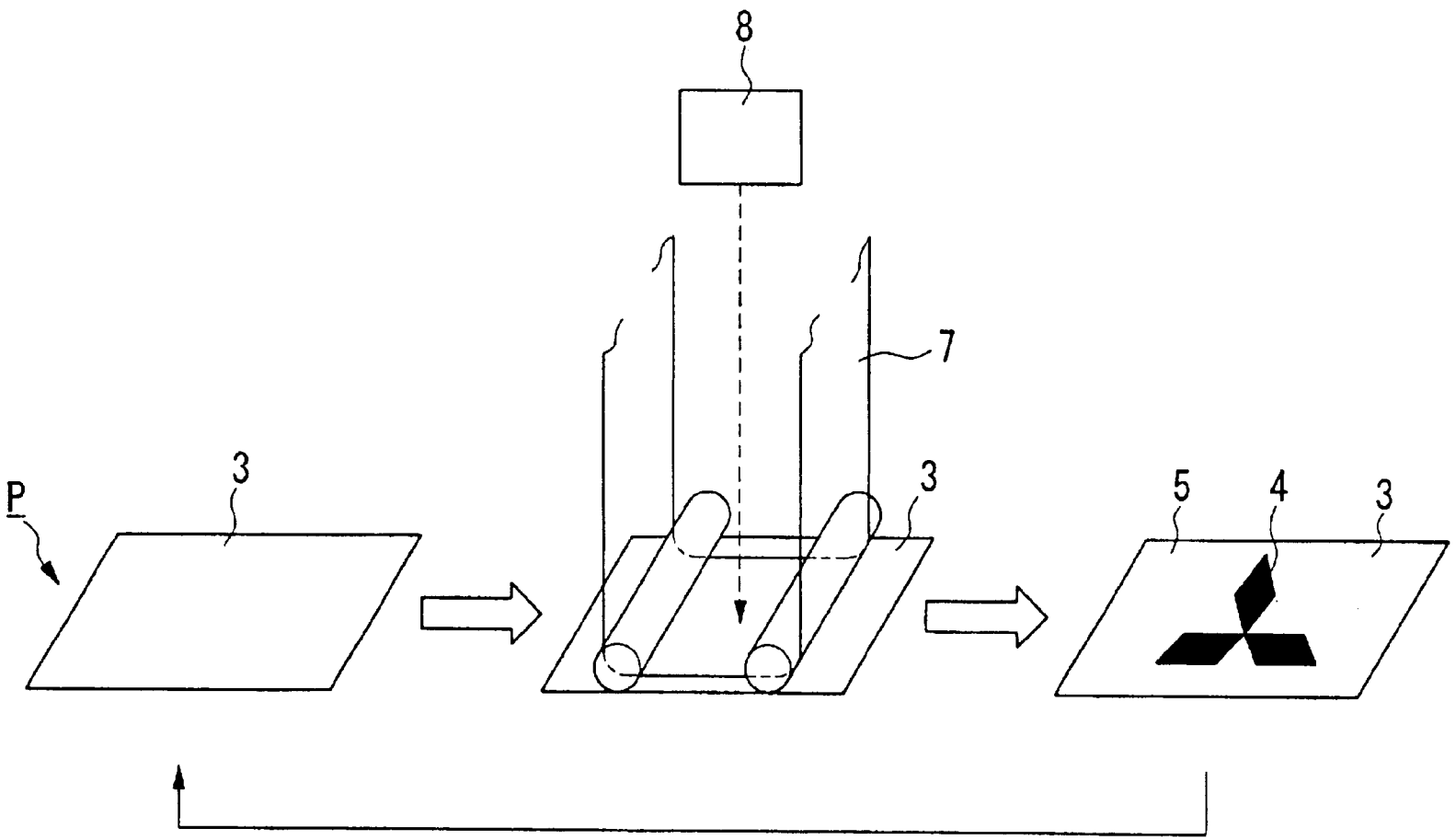
FIG. 4A shows a printing plate in the initial state of plate-making.
FIG. 4B shows a state in which an image area is formed on the surface of a coating layer by using a laser beam.
FIG. 4C shows a state in which the formation of the image area is completed and is ready for printing.

As a method for forming the hydrophobic image area 4 based on image data, use of a so-called film transfer method, in which a film 7 (e.g., a thermal transfer ribbon) on which the above-mentioned ink type material containing an organic compound is applied and a transfer device 8 are used and an ink type material containing an organic compound is transferred onto the surface of the hydrophilic coating layer 3, is also preferable as shown in FIGS. 4A through 4C. In this method, the film 7 is placed so as to make contact with the coating layer 3, an image is formed on the film 7 by using a laser beam irradiated from the transfer device 8 based on the digital data, and the above-mentioned ink type material containing an organic compound is transferred onto the surface of the hydrophilic plate P. Among the figures which show the concept of the formation of an image area by the film transfer method, FIG. 4A shows a printing plate P in its initial state of plate-making, FIG. 4B shows a state in which the image area 4 is formed on the surface of the coating layer 3 by using a laser beam, and FIG. 4C shows a state in which the formation of the image area 4 is completed and is ready for printing.

Note that although an embodiment in which the transfer device 8 irradiates a laser beam onto the surface of the coating layer 3 is shown in FIGS. 4A through 4C, the transfer device 8 may of course be of other types such as a thermal head.

As mentioned above, in comparison with conventional PS plates, the printing plate P according to the embodiment of the present invention does not require a process in which, after the formation of a hydrophobic portion by reacting photosensitive resins, a hydrophilic portion is exposed by washing out an unreacted photosensitive resin using a developer. Accordingly, it can be said that the printing plate P according to the embodiment of the present invention can be readily used in the digitalization of the printing processes.

After completing the above-mentioned processes, a hydrophobic ink used for printing is applied onto the surface of the coating layer 3. That is, a printing plate, for instance one shown in FIG. 2, is prepared. In FIG. 2, the shaded area indicates a portion where an image is formed by an organic compound which is decomposed by the action of a photocatalyst under irradiation of light having a higher energy than the band gap energy of the photocatalyst, i.e., the area indicates the hydrophobic image area 4 to which the hydrophobic ink is attached. On the other hand, a blank portion, i.e., a hydrophilic portion, indicates a non-image area 5 by which the hydrophobic ink is repelled and is not attached. In this manner a pattern is formed, and accordingly, the surface of the coating layer 3 can be used as a printing plate. Also, when a hydrophobic printing ink is applied onto the coating layer 3, the ink may be mixed with water. After this a normal printing process may be carried out and completed.

Next, a method for reusing a plate by regenerating the plate according to an embodiment of the present invention will be explained.

Note that the term "regeneration of a plate" means the return of a plate to the state of "an initial state of plate-making" by converting the surface of the plate, at least a part of which exhibits hydrophobic properties and the remainder exhibits hydrophilic properties, so as to be entirely and uniformly hydrophilic.

It is possible to return the printing plate P to the initial state of plate-making by first wiping off an adhering ink, water, paper dust and so forth from the surface of the coating layer 3 in an ink removing process after the termination of a printing process, and second in the subsequent regeneration process, by irradiating a light having a higher energy than the band gap energy of the photocatalyst onto the surface of the plate, at least a part of which exhibits hydrophobicity, to decompose the organic compound which forms the image area 4 so that the surface of the printing plate P turns into a hydrophilic surface having a contact angle of about 10° with respect to water W. The characteristics of the plate of which the organic compound present on the plate surface is decomposed and removed to give high hydrophilicity to the plate by the irradiation of a light having a higher energy than the band gap energy of the photocatalyst, e.g., ultraviolet light, is derived from the properties of the titanium oxide photocatalyst used.

As for the types of the above-mentioned organic compound, it is preferable to use one which not only reacts or strongly interacts with the hydrophilic portion of the plate surface to give a hydrophobic property to the surface but can also be easily decomposed by the action of the titanium oxide photocatalyst under the irradiation of the ultraviolet light.

More specifically, according to an embodiment of the present invention, use of an organotitanium compound and an organosilicone compound, such as an organosilane compound is preferable. Since these compounds are fixed on the plate surface by reacting with the hydroxyl groups of the titanium oxide photocatalyst, a hydrophobic group monolayer is theoretically formed on the surface of the titanium oxide photocatalyst.

A reaction scheme I, where a tetraalkoxide type organic titanium is used as an example of the organotitanium compound, is shown below.

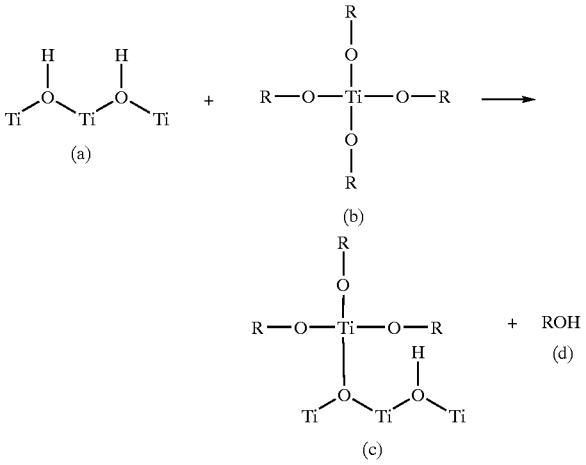

where (a) indicates the surface of titanium oxide (hydrophilic), (b) indicates an organotitanium compound, (c) indicates the surface of titanium oxide which has been converted to be hydrophobic by the formation of an organic hydrophobic group, and (d) indicates a by-product.

Also, a reaction scheme II, where a trialkoxide type organic silane is used as an example of the organosilane compound, is shown below.

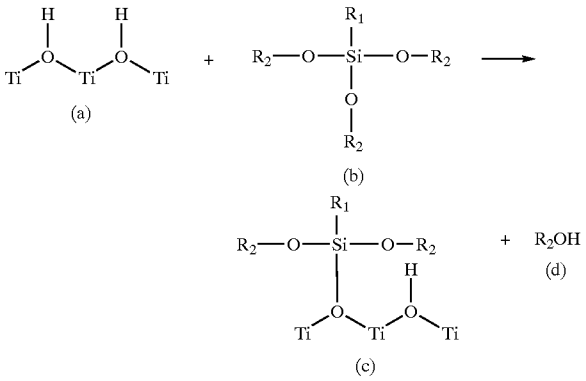

where (a) indicates the surface of titanium oxide (hydrophilic), (b) indicates an organosilane compound, (c) indicates the surface of titanium oxide which has been converted to be hydrophobic by the formation of an organic hydrophobic group, and (d) indicates a by-product.

As shown in the above reaction schemes I and II, the surface of titanium oxide having a hydrophilic property due to the presence of hydroxyl groups is converted to be hydrophobic by the addition of hydrocarbon groups (R, $R_1$, and $R_2$).

Note that the organotitanium compound is not limited to tetraalkoxide type organic titanium and the organosilane compound (i.e., organosilicone compound) is also not limited to trialkoxide type organic silane.

If these organotitanium compounds or organosilicone compounds are used, the hydrophobic group monolayer may be quickly decomposed and removed by the action of the photocatalyst in combination with the irradiation of ultraviolet light when the plate is returned to its initial state of plate-making, after the printing process, and the entire printing surface is converted so as to be hydrophilic again.

That is, in the example shown in the above reaction scheme I, three alkoxy groups (—O—R) bonded to a titanium atom (Ti) derived from the organotitanium compound are decomposed into carbon dioxide ($CO_2$) and water ($H_2O$) and are separated from the titanium atom. Accordingly, only a Ti—O bonding remains on the surface of the titanium oxide. Also, in the example shown in reaction scheme II, an alkyl group (—$R_1$) and alkoxy groups (—O—$R_2$) bonded to a silicon atom (Si) derived from the organosilane compound are decomposed into carbon dioxide ($CO_2$) and water ($H_2O$) and are separated from the silicon atom. Accordingly, only a Si—O bonding remains on the surface of the titanium oxide. Since the hydrocarbon chains are removed from the surface of titanium oxide in this manner, the surface of titanium oxide, which once converted so as to be hydrophobic as shown in (c) in the above reaction schemes I and II, is returned to the state shown in (a) in the reaction schemes I and II, and hence, the coating layer 3 is again converted so as to be hydrophilic.

According to an embodiment of the present invention, since the surface of the plate is easily regenerated by irradiating, for instance, ultraviolet light, it is effective for shortening the time required for the regeneration of the plate and for decreasing the light energy. Also, since the hydrophobic group monolayer is chemically reacted with the surface of the photocatalyst, it has an advantage in that the printing resistance property of the plate becomes very high in comparison with cases where hydrophobic fats and oils are merely applied on the plate surface.

Examples of the organotitanium compounds and the organosilane compounds (i.e., organosilicone compounds) are shown below as categorized in groups 1–3, and 4–7, respectively.

1. alkoxy titanium such as tetraisopropoxy titanium, tetra-n-butoxy titanium, and tetrastearoxy titanium;

2. titanium acylate such as tri-n-butoxy titanium acylate, and isopropoxy titanium triacylate;

3. chelated titanium such as diisopropoxy titanium bisacetylacetonate, and dihydroxy-bislactatotitanium;

4. alkoxysilane such as trimethylmethoxysilane, trimethylethoxysilane, dimethyldiethoxysilane, methyltrimethoxysilane, tetramethoxysilane, methyltriethoxysilane, tetraethoxysilane, methyldimethoxysilane, octadecyltrimethoxysilane, and octadecyltriethoxysilane;

5. chlorosilane such as trimethylchlorosilane, dimethyldichlorosilane, methyltrichlorosilane, methyldichlorosilane, and dimethylchlorosilane;

6. silane coupling agents such as vinyl trichlorosilane, vinyl triethoxysilane, γ-chloropropyltrimethoxysilane, γ-chloropropylmethyldichlorosilane, γ-chloropropylmethyldimethoxysilane, γ-chloropropylmethyldiethoxysilane, and γ-aminopropyltriethoxysilane; and 7. fluoroalkylsilane such as perfluoroalkyltrimethoxysilane.

Note that the organic compounds which may be used according to the embodiment of the present invention are not limited to those shown above. Moreover, the organic compounds may be diluted with, for instance, a solvent, if necessary, and other additives such as hydrophobic fats and oils and fluorinated compounds may be added to the organic compounds.

Further, as the organic compound which is readily decomposed by the action of the titanium oxide photocatalyst under the irradiation of ultraviolet light, it is preferable to use fatty acid dextrin. Since fatty acid dextrin strongly interacts with the hydroxyl groups of the titanium oxide photocatalyst and is fixed onto the surface thereof, the image area formed by fatty acid dextrin may be stably used for a printing process without, for instance, being substituted by water used for moistening.

The structure of dextrin palmitate, which is one example of the fatty acid dextrin, is shown below.

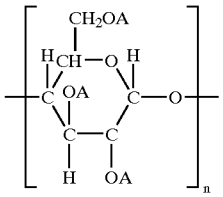

where A represents $C_{15}H_{31}CO$— or H and n indicates the degree of polymerization.

Also, an interactive reaction scheme III, where dextrin palmitate is used, is shown below.

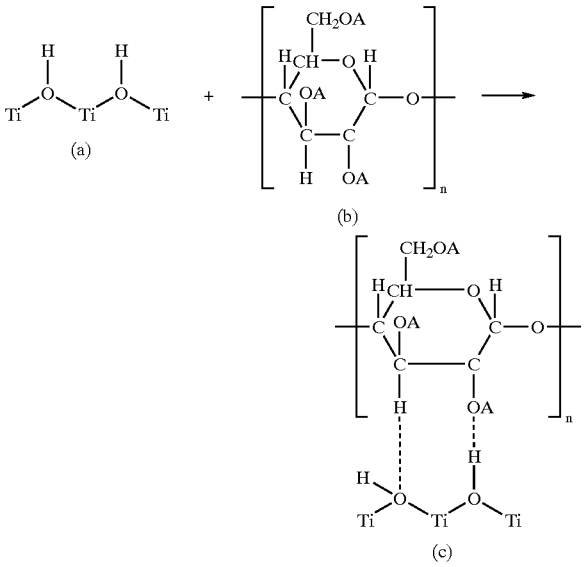

where (a) indicates the surface of titanium oxide (hydrophilic), (b) indicates a fatty acid dextrin, and (c) indicates the surface of titanium oxide converted so as to be hydrophobic by the formation of an organic hydrophobic group.

As shown in the above, since dextrin palmitate is constituted only by carbon (C), hydrogen (H), and oxygen (O), it is decomposed into water and carbon dioxide when irradiated by ultraviolet light. Accordingly, the use of dextrin palmitate has an advantage in that nothing remains on the surface of titanium oxide after the reaction.

Note that although use of dextrin (palmitate/2-ethylhexanoate) and dextrin myristate in addition to dextrin palmitate are suitable, fatty acid dextrin which may be used according to an embodiment of the present invention is not limited as such.

A hydrophobic image area may be formed on the surface of a hydrophilic plate by using the ink jet method (refer to FIGS. 3A through 3C) in which an ink type liquid containing an organotitanium compound, an organosilicone compound, fatty acid dextrin, or a solution of these organic compounds, or by using the film transfer method (refer to FIGS. 4A through 4C) in which a film on which an ink type material containing these types of organic compounds has been applied is placed between the surface of the plate and the transfer device so as to make contact with the plate surface, an image is drawn on the film by using a laser beam or a thermal head based on digital data, and the ink type material containing the above-mentioned organic compounds is transferred to the hydrophilic plate surface. Also, the subsequent printing process may be started after drying the image area formed by the ink type liquid or the ink type material containing the organic compound present on the plate surface by using a drying device, if necessary.

Figure 5:
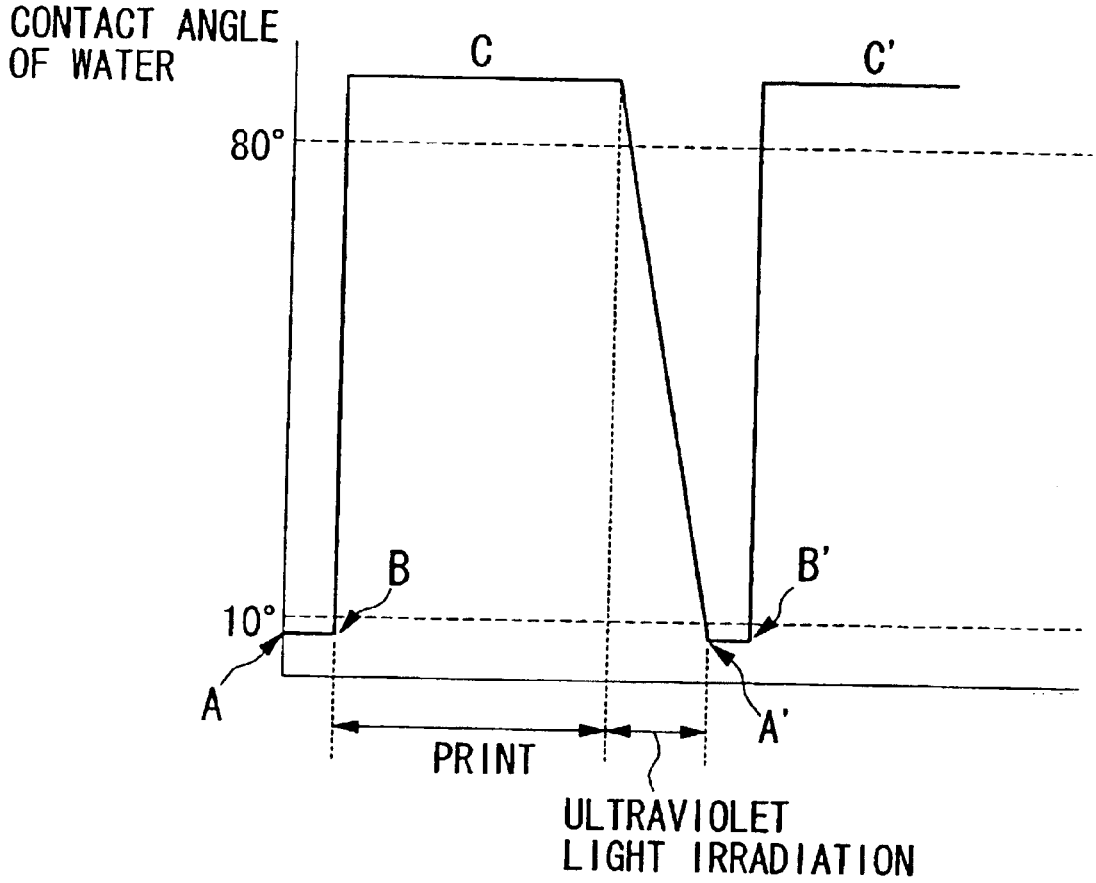
FIG. 5 is a graph for explaining the formation of an image area on a hydrophilic plate surface by using an organic compound and the removal of the image area after the completion of a printing process by the irradiation of ultraviolet light in relation to time.

FIG. 5 is a graph for explaining the above-mentioned property of the plate in relation to the contact angle with water. In the graph shown in FIG. 5, time (or operation) is plotted on the horizontal axis and the contact angle with respect to water is plotted on the vertical axis. Accordingly, in connection with the printing plate according to the embodiment of the present invention, the change in the contact angle with water (i.e., hydrophobic⇆hydrophilic states) in relation to time or operation is shown in the graph.

As shown in the graph in FIG. 5, the surface of the coating layer 3 initially shows a high hydrophilic property having the contact angle with water of about 10° or preferably less than 10° by the irradiation of ultraviolet light and this is the "initial state of plate-making" (indicated by the point A in FIG. 5). After this a hydrophobic image area is formed on at least a part of the surface of the coating layer 3 to make a printing plate by using a method such as the ink jet method or the film transfer method. Then, as indicated by the straight line C in FIG. 5, a printing process is carried out. Note that in FIG. 5, the letter B indicates the start of the printing process.

After the completion of the printing process and the cleaning off of deposits and contaminants adhering to the coating layer 3, the image area formed by the above-mentioned organic compound is decomposed and removed by the irradiation of the ultraviolet light and the surface of the coating layer 3 is again converted so as to be hydrophilic (indicated by the point A' in FIG. 5). That is, the plate is returned to the "initial state of plate-making", and it may be used for printing process repeatedly.

As mentioned above, the reusing method for the printing plate according to an embodiment of the present invention has an advantage in that the reusing (i.e., recycling) process may be promptly carried out. That is, by adapting a titanium oxide photocatalyst in combination with a technique by which an image area is formed based on digital data by using an ink type material containing an organic compound which is readily decomposed by the action of the titanium oxide photocatalyst under the irradiation of ultraviolet light, the time required for both the production of the plate and the regeneration of the plate may be shortened. Accordingly, it becomes possible to perform the entire printing process very quickly.

Next, concrete embodiments of the invention relating to the printing plate and the printing system confirmed by the inventors of the present invention will be described in detail as follows.

A base material, which is made of aluminum, of post card size with a thickness of 0.3 mm was prepared, and a primer LAC PR-01 (a product of Sakai Chemical Industry Co., Ltd.) was applied onto the base material and was dried. The thickness of the primer was 0.8 $\mu$m after drying. Note that the primer layer corresponds to the intermediate layer 2 shown in FIG. 1. After this, a titanium oxide photocatalyst coating agent LAC TI-01 was applied and dried at 100° C. to produce a coating layer 3 of 0.4 μm containing a titanium oxide photocatalyst.

Then, after ultraviolet light having an illuminance of 40 $mW/cm^2$ was irradiated over the entire plate surface for 20 seconds by using a mercury lamp, the contact angle of the portion irradiated by the ultraviolet light with respect to water was immediately measured by using a CA-W type contact angle measuring instrument. As a result, the measured contact angle was found to be 7° and it was confirmed that the portion showed a sufficient hydrophilicity as a non-image area and was in the initial state of plate-making.

Then, a solution (liquid A), in which 2 g of tetra-n-butoxy titanium (a product of Nippon Soda Co., Ltd.) was dissolved in Isoper L (a product of Exxon Chemical Co.), was discharged onto the plate surface in the initial state of plate-making by using a commercially available ink jet head to form dot images having image proportions from 10% to 100% with a 10% interval, and the plate was dried at 60° C. for five minutes to make a printing plate. After this, the contact angle of the image area of the image proportion at 100% with respect to water was measured by using the CA-W type contact angle measuring instrument. As a result, the measured contact angle was found to be 102° and it was confirmed that hydrophobic image area was formed and that the portion showed a sufficient hydrophobicity as an image area.

The plate thus prepared was mounted in a bench offset printing machine New Ace Pro (a product of Alpha Giken Co., Ltd.) and a printing process was carried out at a printing rate of 3,500 sheets/hour using the ink HYECOO B red MZ (a product of Toyo Ink Mfg. Co., Ltd.), water for moistening (Lithofellow 1% solution, a product of Mitsubishi Heavy Industries, Ltd.), and a sheet of paper (ibest paper). As a result, the ink was adhered to the portions on the plate where the dotted images were formed by the liquid A, whereas the ink did not adhere to the portions on the plate where no image was formed by the liquid A, and accordingly, dotted images were printed on the paper.

Next, an embodiment of the present invention relating to the regeneration of the printing plate will be explained. After the completion of the printing process and wiping off the ink, water, paper dust and so forth adhered to the plate, ultraviolet light at an illuminance of 40 $mW/cm^2$ was irradiated over the entire plate surface for 20 seconds by using a mercury lamp. After this, the contact angle of the portion where the dotted image had been present was immediately measured by using the CA-W type contact angle measuring instrument. As a result, the measured contact angle was found to be 8° and it was confirmed that the portion showed a sufficient hydrophilicity as a non-image area and was in the initial state of plate-making. Accordingly, the plate was successfully regenerated.

Figure 6:
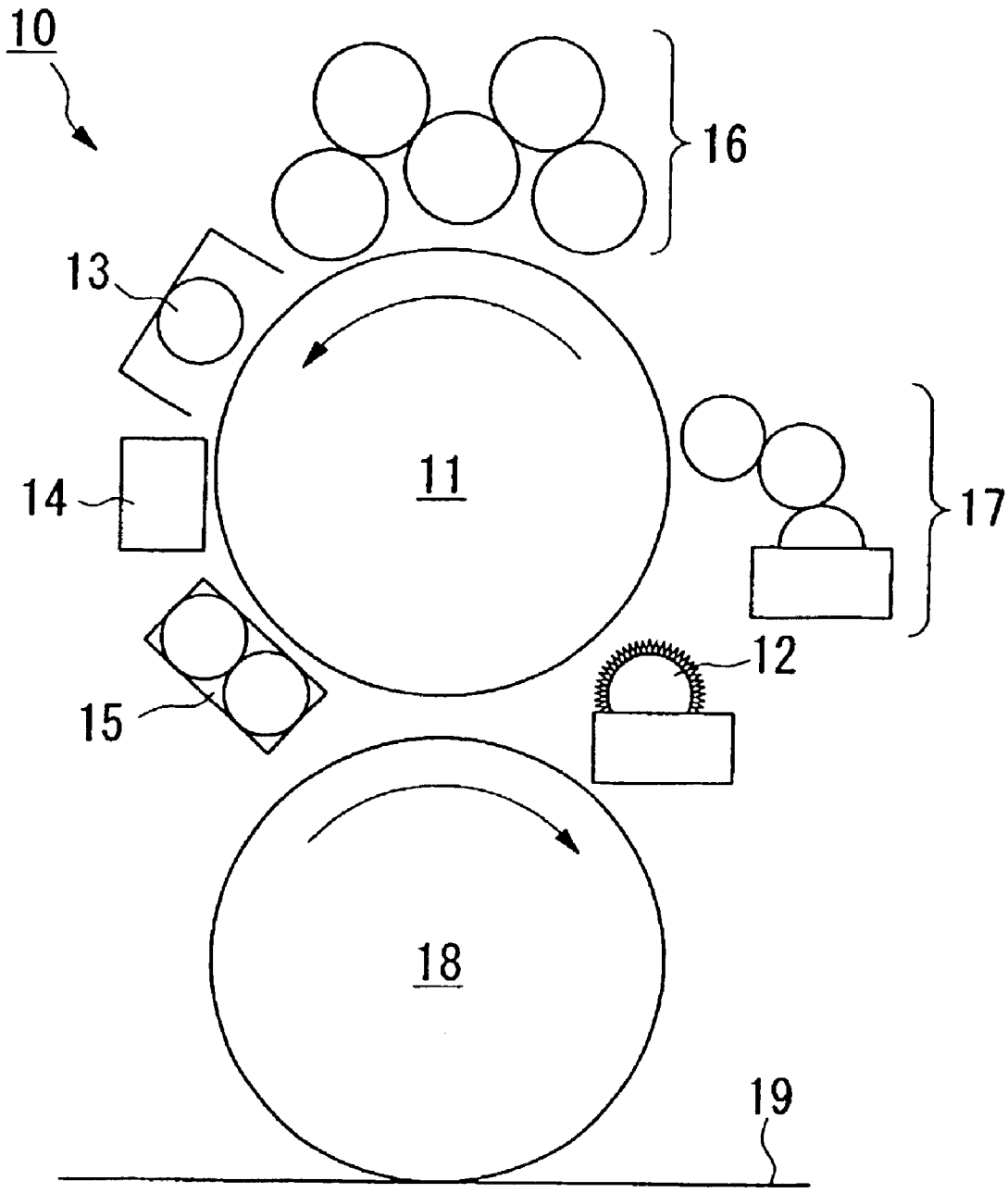
FIG. 6 is a schematic structural diagram showing an example of the structures of a printing machine according to an embodiment of the present invention.

Note that it is preferable to use a printing machine 10 as shown in FIG. 6 in order to carry out the above-mentioned printing process and the plate regeneration process. The printing machine 10 includes a print drum 11 located at the center, a plate cleaner 12, an ultraviolet light irradiation device (a light irradiation device) 13, an image forming device 14, a dryer 15, inking rollers 16, a moistening water feeder 17, and a blanket drum 18. A printing plate P (not shown in FIG. 6) is placed so as to surround the print drum 11.

The plate cleaner 12 is used to remove ink, moistening water, paper dust and so forth from the coating layer 3 after the printing process.

The ultraviolet light irradiation device 13 is used to decompose and remove the organic compounds forming the image area 4 by irradiating ultraviolet light onto the surface of the coating layer 3.

The image forming device 14 is used to form a hydrophobic image area 4 by using an ink type material containing an organic compound which may be decomposed and removed by the irradiation of the ultraviolet light, i.e., an organotitanium compound, an organosilicone compound, or a fatty acid dextrin. The image forming device 14 may be configured to have the ink jet head 6 shown in FIG. 3B or the film 7 and the transfer device 8 shown in FIG. 4B. That is, the image area 4 may be formed by using the ink jet method or the film transfer method, whichever is suitable.

The dryer 15 is used to evaporate unnecessary components such as volatile constituents contained in the ink type material forming the image area 4, which has been applied on the coating layer 3, by drying the coating layer 3.

The ultraviolet light irradiation device 13, the image forming device 14, and the dryer 15 are placed so as to surround the print drum 11 in that order with respect to the direction of rotation (indicated by the arrow in FIG. 6) of the print drum 11. Accordingly, production and regeneration of the plate may be carried out continuously in association with the rotation of the print drum 11, and hence, the production and regeneration of the plate can be efficiently performed.

The regeneration process for the plate, which has been used for the printing process, may be carried out by using the printing machine 10 as follows. First, the plate cleaner 12 is set to the position where it makes contact with the print drum 11 so that ink, moistening water, paper dust and so forth attached to the plate may be wiped off from the plate by the plate cleaner 12. After that the plate cleaner 12 is separated from the print drum 11 and the entire plate surface is irradiated by ultraviolet light emitted from the ultraviolet light irradiation device 13 in order to convert the plate surface so as to be hydrophilic. In this manner, the plate is returned to the initial state of plate-making.

After this, the ink type material containing an organic compound, which may be readily decomposed by the action of the titanium oxide photocatalyst under the irradiation of ultraviolet light, is applied onto the coating layer 3 by using the image formation device 14 based on digital data of an image which are prepared in advance. Then, the surface of the print drum 11, i.e., the coating layer 3, is dried by heat using the dryer 15, if necessary. After the completion of the above-mentioned processes, the inking rollers 16, the moistening water feeder 17, and the blanket drum 18 are placed at positions where they may make contact with the print drum 11. When a sheet of paper 19 is conveyed in the direction indicated by the arrow in FIG. 6 while making contact with the blanket drum 18, a printing process is carried out continuously.

By using the printing machine 10 shown in FIG. 6, it becomes possible to perform both the plate regeneration process and the printing plate-making process, in which the organic compound that may be readily decomposed by the action of the titanium oxide photocatalyst under the irradiation of the ultraviolet light is used for the formation of the image area, on the same printing machine, while the plate is maintained mounted to the print drum 11. Accordingly, it also becomes possible to carry out a series of printing processes continuously without stopping the printing machine 10 nor having to perform the troublesome operation of exchanging the plate.

Note that although the plate is placed so as to surround the print drum 11 in the above-mentioned printing machine 10, it is not limited as such, and for instance, a coating layer 3 containing a titanium oxide photocatalyst may be directly formed on the surface of the print drum 11, i.e., a print drum and a plate may be uniformly formed and used according to an embodiment of the present invention.

As explained above, according to the method for making a printing plate, the reusing method for the printing plate, and the printing machine of the embodiments of the present invention, it becomes possible to regenerate and recycle a plate by utilizing properties of the titanium oxide photocatalyst, i.e., a property of being made hydrophilic by the irradiation of light having a higher energy than the band gap energy of the photocatalyst and a property of decomposing an organic material, in combination with the technique by which an image area is formed based on digital data by using an ink type liquid or an ink type material containing an organic compound which is readily decomposed by the action of the titanium oxide photocatalyst under the irradiation of ultraviolet light. Accordingly, the number of plates which are discarded after use can be significantly decreased, and hence, the costs for the plates may also be significantly reduced.

Also, according to the present invention, since an image may be formed directly onto the plate, it is applicable to digitization of the printing processes, and therefore, it becomes possible to significantly reduce the time and cost which would have been required without digitalization. Moreover, as compared with conventional PS plates, no developing process is necessary and therefore no waste liquid derived from the developing process is generated.

Further, since both the plate-making process and the print regeneration process may be carried out using the same printing machine, it becomes possible to promptly carry out the printing operation.

In conclusion, according to the method for making a printing plate, the reusing method for the printing plate, and the printing machine of the present invention, the number of plates which are discarded after use may be significantly reduced by regenerating and recycling the plate, and hence, the costs relating to the plates may also be decreased. Also, since the time required for the regeneration of a plate in the printing process is shortened, the time needed for the preparation of a printing process may also be shortened. Moreover, by directly making the plate from digital data, it becomes possible to digitalize the printing process, and the time required for the printing processes may be significantly reduced. Further, since the plate-making process and plate regeneration process may be carried out while the plate is maintained mounted to the printing machine, no plate exchanging process is required and therefore, the efficiency thereof may further be improved.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A method for making a printing plate comprising the step of: forming a hydrophobic image area on at least a part of a hydrophilic surface of a plate containing a photocatalyst by transferring to the plate a film on which an ink type material has been applied with a transfer device;

said ink type material containing an organic compound which is decomposable and removable by the irradiation of light having a higher energy than a band gap energy of said photocatalyst.

2. A method for making a printing plate according to claim 1, wherein said photocatalyst is a titanium dioxide photocatalyst.

* * * * *